US006270379B1

(12) United States Patent
Huang et al.

(10) Patent No.: US 6,270,379 B1
(45) Date of Patent: Aug. 7, 2001

(54) CONNECTOR WITH SECURELY RETAINED CONTACTS

(75) Inventors: Nan-Tsung Huang; Kun-Tsan Wu, both of Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/450,478

(22) Filed: Nov. 29, 1999

(30) Foreign Application Priority Data

Sep. 14, 1999 (TW) ..... 88115817
Sep. 14, 1999 (TW) ..... 88215733

(51) Int. Cl.[7] ..... H01R 24/06
(52) U.S. Cl. ..... 439/660; 439/607
(58) Field of Search ..... 439/660, 607, 439/609

(56) References Cited

U.S. PATENT DOCUMENTS 5,643,013 * 7/1997 Weidler et al. ..... 439/660
5,785,557 * 7/1998 Davis ..... 439/660
5,971,809 * 10/1999 Ho ..... 439/660
5,975,954 * 11/1999 Wu et al. ..... 439/607
5,993,263 * 11/1999 Sampson ..... 439/660
6,007,379 * 12/1999 Michaelis et al. ..... 439/607
6,007,382 * 12/1999 Wu ..... 439/607

* cited by examiner

*Primary Examiner*—Gary F. Paumen
(74) *Attorney, Agent, or Firm*—Wei Te Chung

(57) ABSTRACT

An electrical connector of the present invention comprises an insulative housing, a plurality of contacts and a shield. The housing comprises a body portion rectangular in shape and having a receiving cavity in a rear side thereof. A protruding portion extends forward from a front wall of the body portion defining contact holding slots therein. The protruding portion has a front portion forming latching shelves extending rearward into the contact holding slots. Each contact includes a base section, with a horizontal section and a solder tail extending respectively from a front end and a rear end of the base section, and a spring contact section extending upward and rearward from a front end of the horizontal section. The horizontal section is provided at the front thereof with a notch for locking to the latching shelf of the protruding portion so that the contacts are fixed in the housing firmly. Upon full insertion of a mating plug in the connector, the horizontal section is prevented from being displaced from the contact holding slots by the notch being interlocked with the latching shelf.

1 Claim, 11 Drawing Sheets

CONNECTOR WITH SECURELY RETAINED CONTACTS

BACKGROUND OF THE INVENTION

1. Field of the Invention

The present invention relates to an electrical connector, and particularly to an improved electrical connector for electrically connecting a mating connector to a printed circuit board.

2. Description of the Prior Art

Examples of prior art connectors are disclosed in Taiwan patent application Nos. 84213272, 85210936, 85218284 and 86218866. Referring to FIG. 11, a conventional connector comprises an insulative housing 5, a plurality of contacts 6 and a shield 7. A plurality of contact receiving slots 51 are provided through the housing 5 for receiving the corresponding contacts 6. Each contact 6 includes a retention portion 62, a spring contact portion 63 for connecting with a mating connector, a solder tail 61 downwardly extending from the retention portion 62 for soldering to a printed circuit board. The connector defines a rectangular ring opening 52 in a top surface thereof wherein a mating connector may be inserted.

In the conventional connector described above, the contacts 6 have only the retention section 62 fixing then in the receiving slots 51 of the housing 5 so that they may be easily displaced from their position in the receiving slots 51. The contact section 63 of each 62 contact is forwardly bent from the retention section so that there is a general U-shaped transition between the retention section 62 and the spring section 63. When a mating connector is repeatedly inserted into the connector the U-shaped transition 65 may lose resiliency and permanently deform, thus causing poor electrical connection between the contact 6 and a terminal in a mating connector.

Accordingly, an improved electrical connector is required to overcome the disadvantages of the prior art.

SUMMARY OF THE INVENTION

A first object of the present invention is to provide an electrical connector whose contacts include a device for being received and fixed in the housing.

A second object of the present invention is to provide an electrical connector having a shield defining a chamfer at the intersection of two walls and adjacent to a solder tab, so that solder area is increased and the soldering contact thus strengthened.

In view of the foregoing, the present invention includes an insulating housing, a plurality of contacts and a shield. The housing comprises a body portion defining a receiving cavity in a rear side thereof and a protruding portion at a front side thereof. The protruding portion defines a plurality of contact holding slots extending from the front wall of the body portion. A latching shelf is formed in a front portion of each of the holding slots in the protruding portion, each latching shelf extending rearward into a corresponding holding slot. Each contact includes a base section received in the contact receiving cavity, a solder tail extending rearward from a rear end of the base section, a horizontal section extending forward from a front end of the base section, and a spring contact section extending upward and rearward from a front end of the horizontal section. The horizontal section is provided at the front thereof with a notch for locking to the latching shelf of the protruding portion so that the contacts are fixed in the housing firmly. The contacts are produced using a stamping process, and the arc-shaped spring contact section has sufficient resiliency so that it does not easily deform when a mating connector is repeatedly inserted into the connector. That is one of advantages and novel features of the present invention. The shield is tabular in shape with a D-shaped cross section. Two pair of solder tabs are formed at a lower sides of the side plates thereof. A chamfer is formed between a bottom plate and each side plate of the plate of the shield adjacent a pair of solder tabs thereby increasing area of the shield.

DETAILED DESCRIPTION OF THE INVENTION

Figure 1:
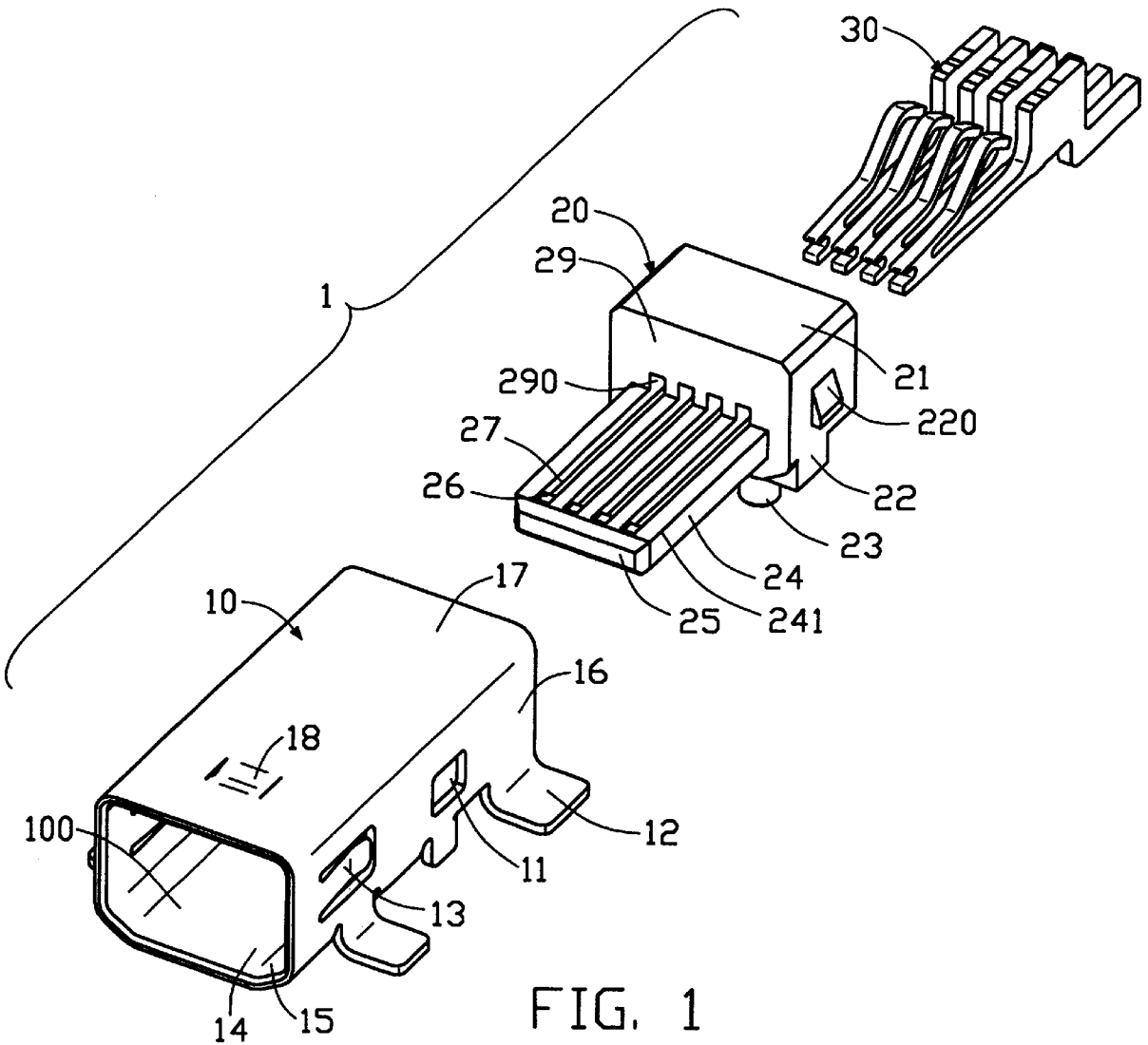
FIG. 1 is an exploded view of an electrical connector in accordance with a first embodiment of the present invention.

As shown in FIG. 1, an electrical connector in accordance with a first embodiment of the present invention comprises an insulative housing 20, a plurality of contacts 30 and a shield 10.

Figure 4:
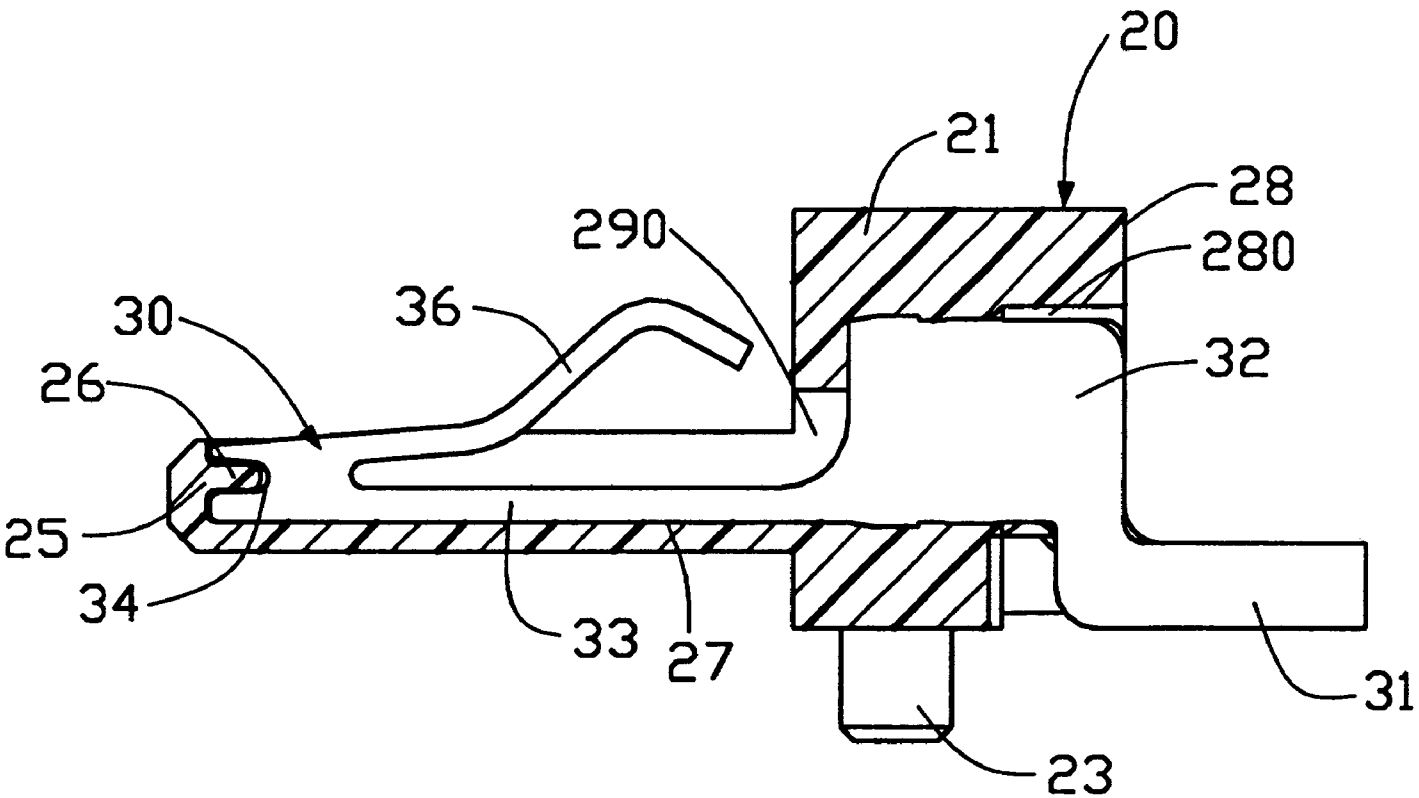
FIG. 4 is a sectional view taken along line 4—4 of FIG. 3.

The housing 20 includes a rectangular body portion 21 having a front wall 29,a rear wall 28 opposite the front wall 29, two side walls 22, and top and bottom walls (not labeled). An internal contact receiving cavity 280 (FIG. 4) is defined in the rear wall 28. A Protrusion 220 is provided on each side wall 22 of the body portion 21. A pair of orientation legs 23 is formed on the bottom wall of the body portion 21 for orienting the housing during soldering. The housing 20 forms a protruding portion 24 projecting forward from the front wall 29 of the body portion 21. A plurality of contact holding slots 27 is defined in an upper surface 241 of the protruding portion 24. The protruding portion 24 has a front portion 25 which forms a rectangular latching shelf 26 protruding rearward into each contact holding slot 27 (FIGS. 1 and 4). Openings 290 in the front wall 29 provide communication between the receiving cavity 280 and the holding slots 27.

Figure 2:
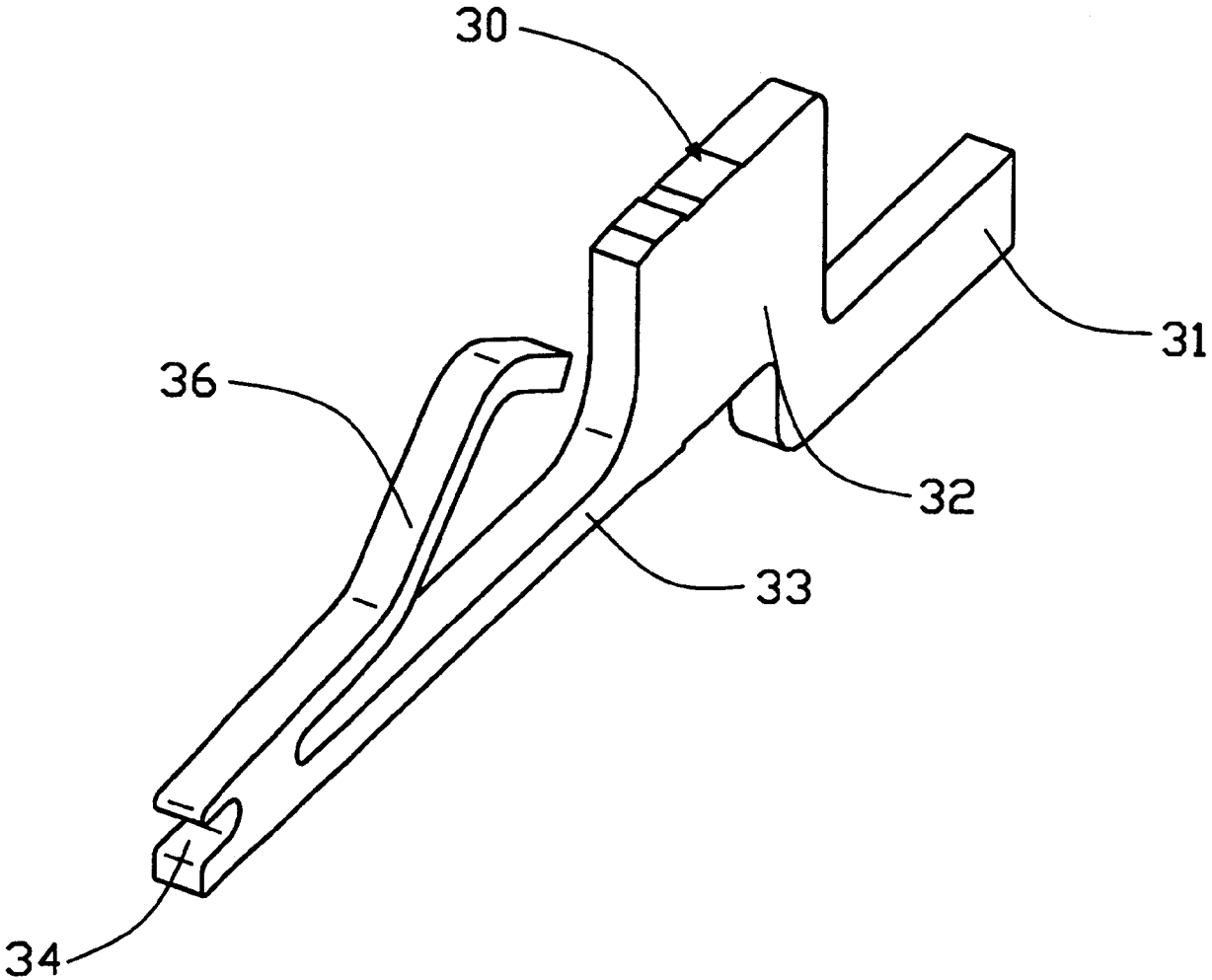
FIG. 2 is a perspective view of a contact of FIG. 1.

Referring to FIG. 2, each of the contacts 30 which are formed from a metal sheet via a directly stamping process, comprises a rectangular base section 32, a solder tail 31, a horizontal section 33 and an arc-shaped spring contact section 36. The solder tail 31 and the horizontal section 33 extend respectively from a rear side and a front side of the base section 32. The spring contact section 36 extends upward and rearward from a front end of the horizontal section 33 for connection with a mating contact. A notch 34 is provided on the front end of the horizontal section 33.

Referring back to FIG. 1, the shield 10 has a generally D-shaped cavity 100 to receive the mating connector and the assembly of the housing and the contacts. An indentation 18 is punched in a forward part of the top wall 17, and a pair of grounding fingers 13 and engaging holes 11 are respectively defined on front and rear portion of opposite side plates 16. The indentation 18 and the grounding fingers 13 serve both to fasten a mating connector within the connector and to ground the shield of a mating connector. A chamfer 15 is provided between a bottom plate 14 and each side plate 16. A pair of solder tabs 12 are provided at the lower end of each side plate for soldering to a printed circuit board. The bottom 14 extends from a front end of the shield to a position approximately halfway to the rear of the shield 10.

Figure 3:
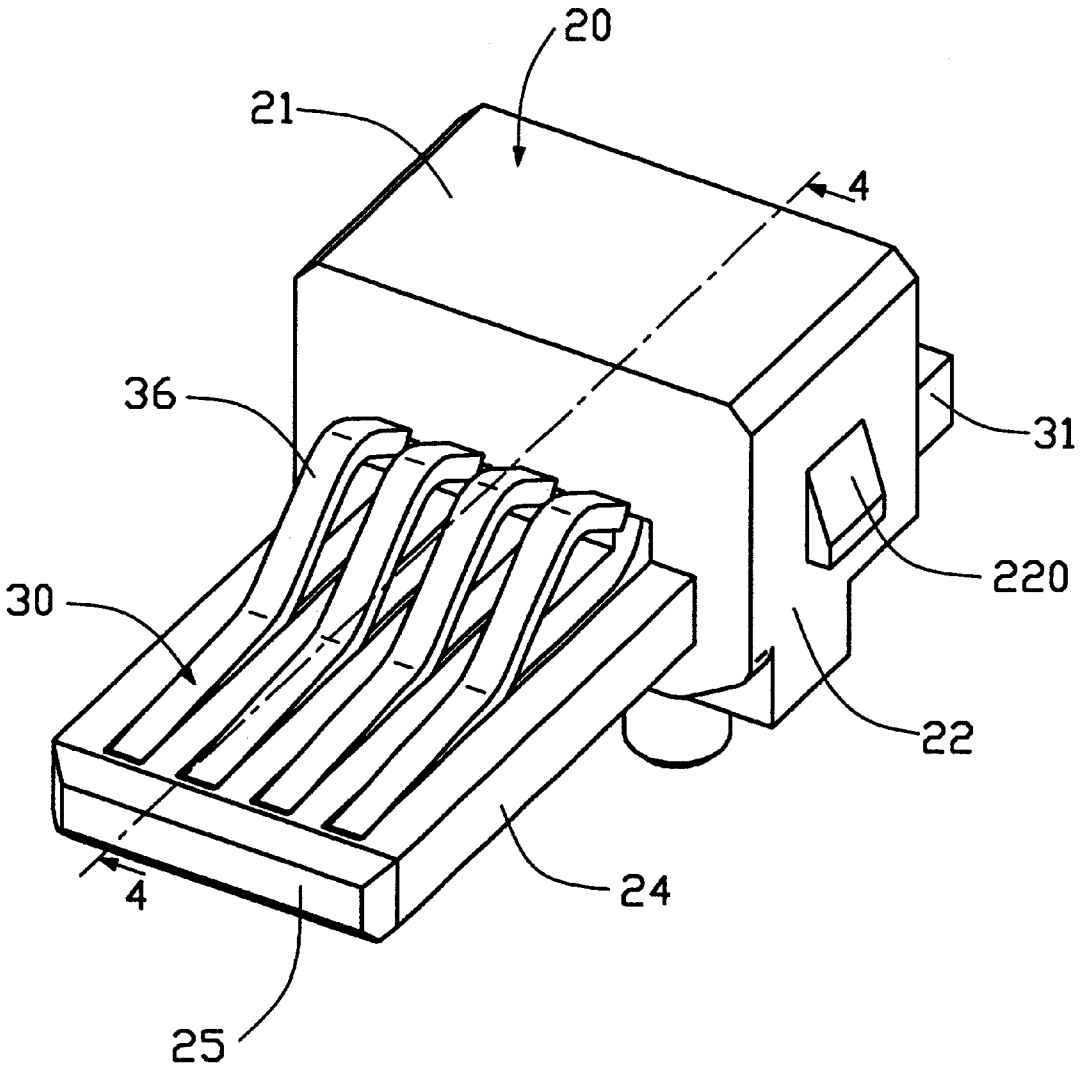
FIG. 3 is an assembled view of contacts and a housing of an electrical connector in accordance with the present invention.
Figure 5:
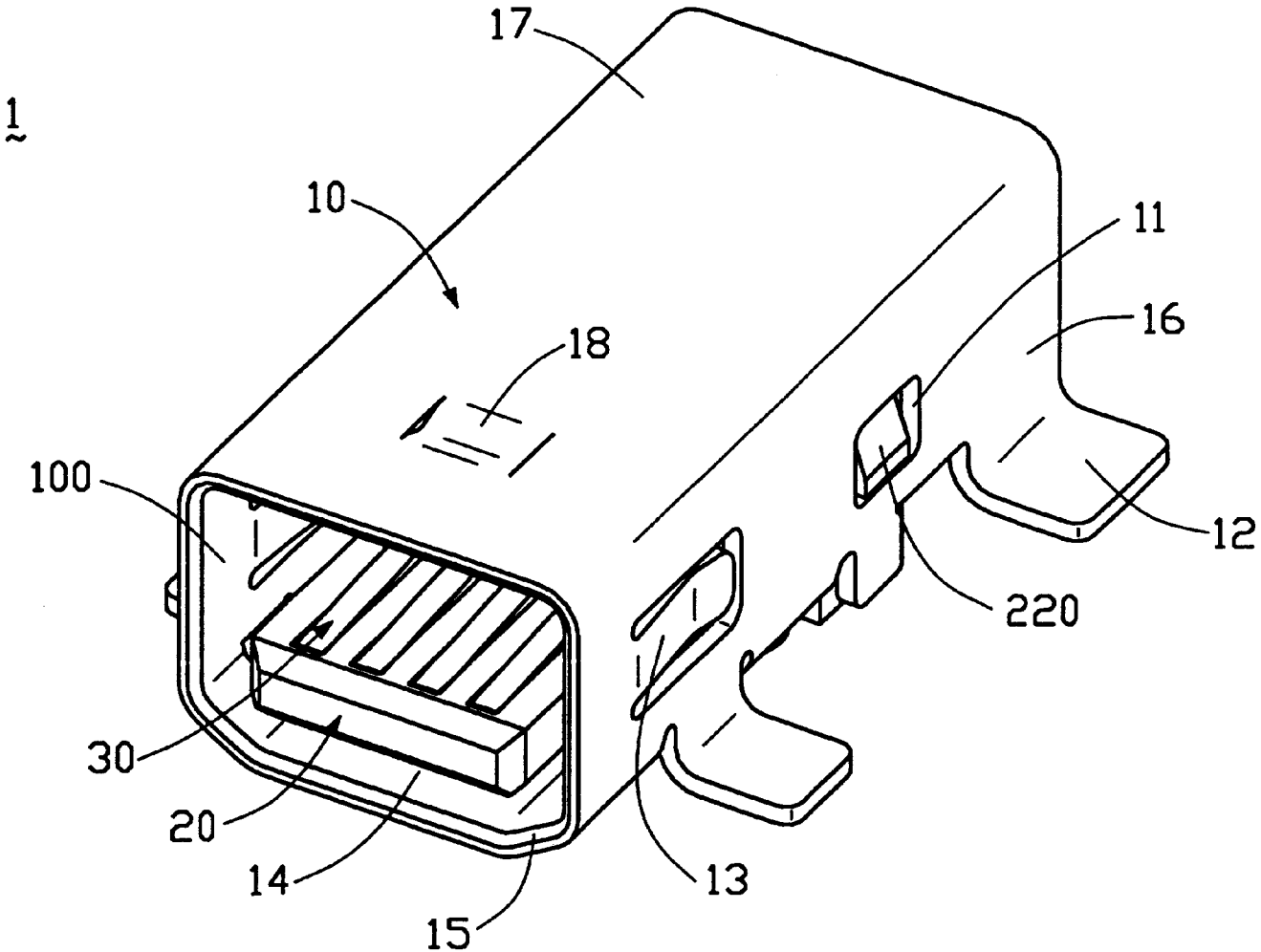
FIG. 5 is an assembled perspective view of the electrical connector in accordance with the present invention.

Referring to FIGS. 3–5, the contacts 30 are inserted into the housing 20 from the rear side thereof, the base sections 32 being received in the receiving cavity 280 and the solder tails 31 extending horizontally out of the housing 20 for soldering onto the printed circuit board. The horizontal sections 33 of the contacts 30 are inserted through the openings 290 in the front wall 29 and are received in the contact holding slots 27. The notches 34 of the contacts 30 are lock with the latching shelves 26 of the front portion 25 so that the horizontal portions 33 cannot be displaced from the contact holding slots 27. Accordingly the contacts 30 are fixed firmly in the housing 20. The arc-shaped spring contact sections 36 have sufficient resiliency that they can be inserted through the openings 290 in the housing 20 and resume their original shape. The spring contact sections 36 resiliently contact terminals of a mating connector thus assuring successful electrical connection therebetween. The protrusions 220 of the housing 20 lock in the engagement holes 11 of the shield 10 thereby effectively retaining the housing 20 and contacts 30 in the receiving cavity 100 of the shield 10. The chamfers 15 provided between the bottom plate 14 and each side plate 16 of the shield 10 assure correct insertion of a mating connector into the connector. When the solder tabs 12 are soldered to the printed circuit board the chamfers 15 increase the soldering area, thereby strengthening the solder connection. The solder tabs 12 of the shield 10 and the solder tails 31 of the contacts 30 fix the connector 1 on the printed circuit board.

Figure 6:
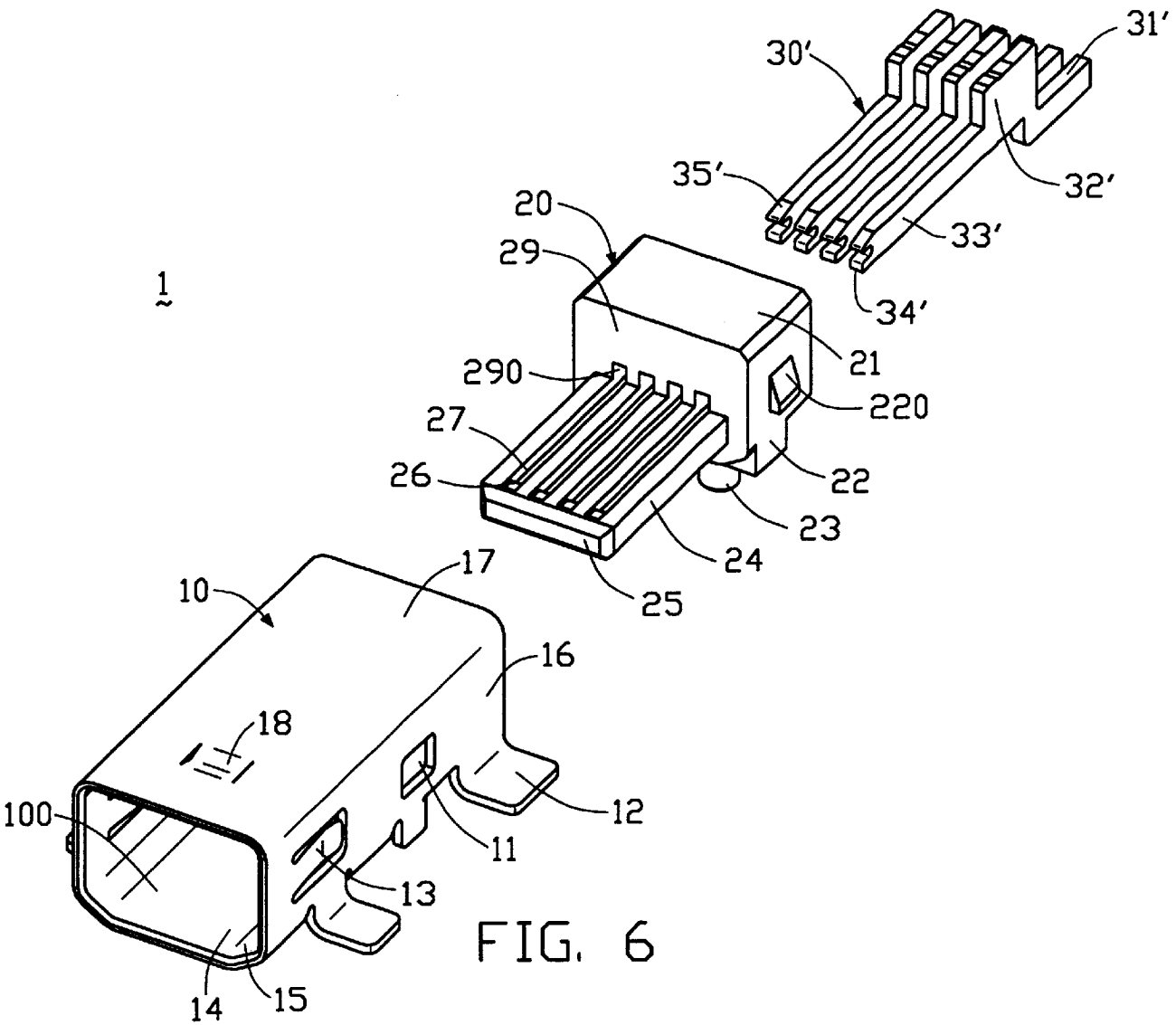
FIG. 6 is an exploded view of a second embodiment in accordance with the present invention.
Figure 7:
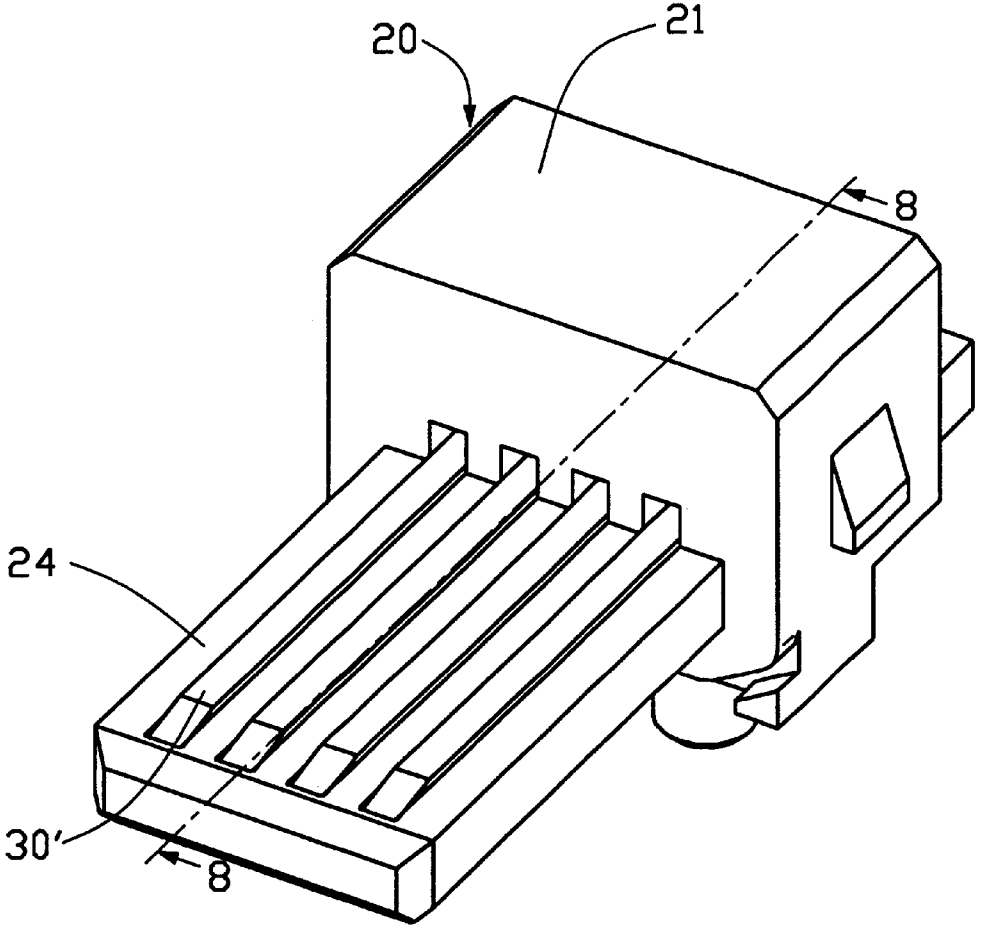
FIG. 7 is an assembled view of contacts and a housing of a second embodiment in accordance with the present invention.
Figure 8:
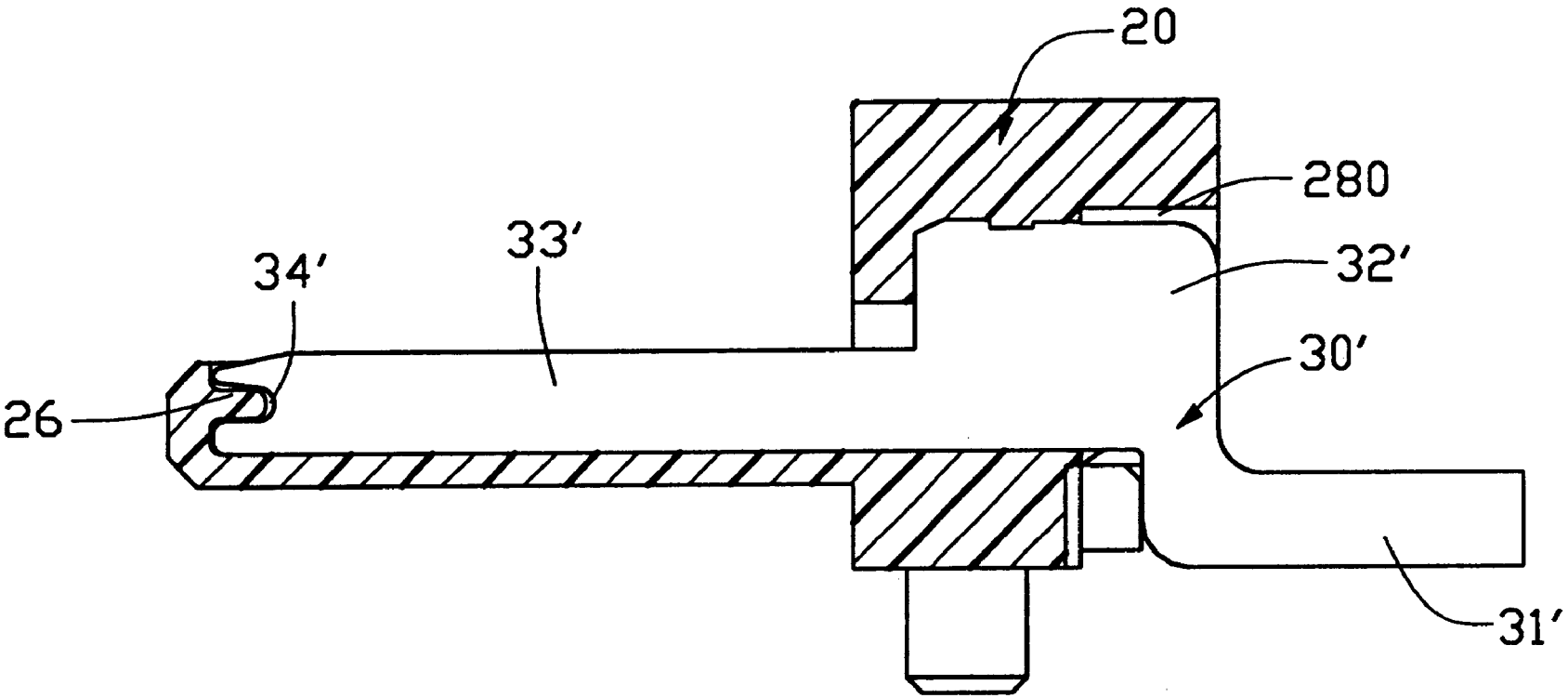
FIG. 8 is a sectional view taken along line 8—8 of FIG. 7.

FIGS. 6–8 shows a second embodiment of the present invention. The second embodiment is the same as the first embodiment with the exception that contacts 30' only include a base section 32', a solder tail 31' and a horizontal section 33'. The spring contact section 36 of the first embodiment has been eliminated and the horizontal section 33' is entirely straight, preventing the contact from deforming upon full insertion of a mating connector. A guide surface 35' is provided at an upper surface of the distal end of the horizontal section 33' for guiding a contact of a mating connector. The contact 30' of this embodiment is manufactured easily and at low cost.

Figure 9:
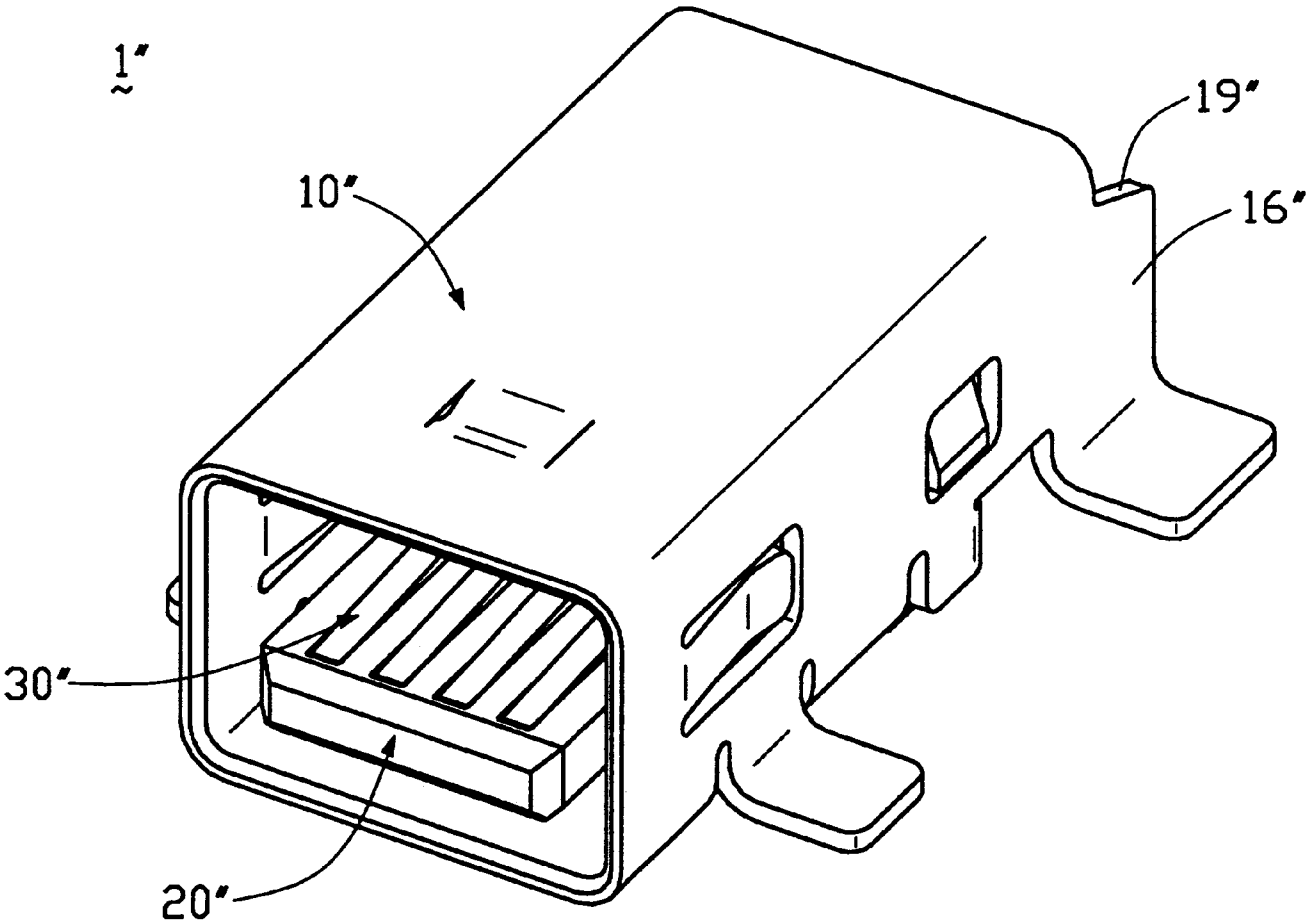
FIG. 9 is a perspective view of a third embodiment in accordance with the present invention.
Figure 10:
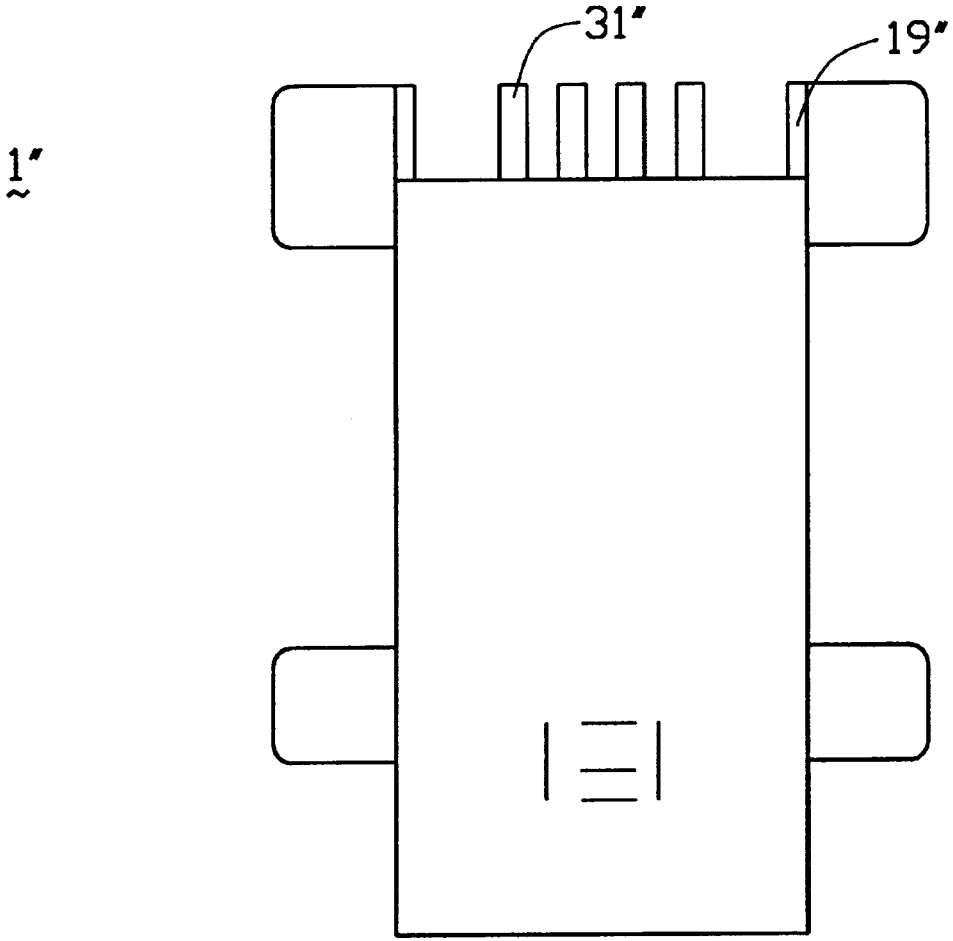
FIG. 10 is a top view of the connector of FIG. 9.
Figure 11:
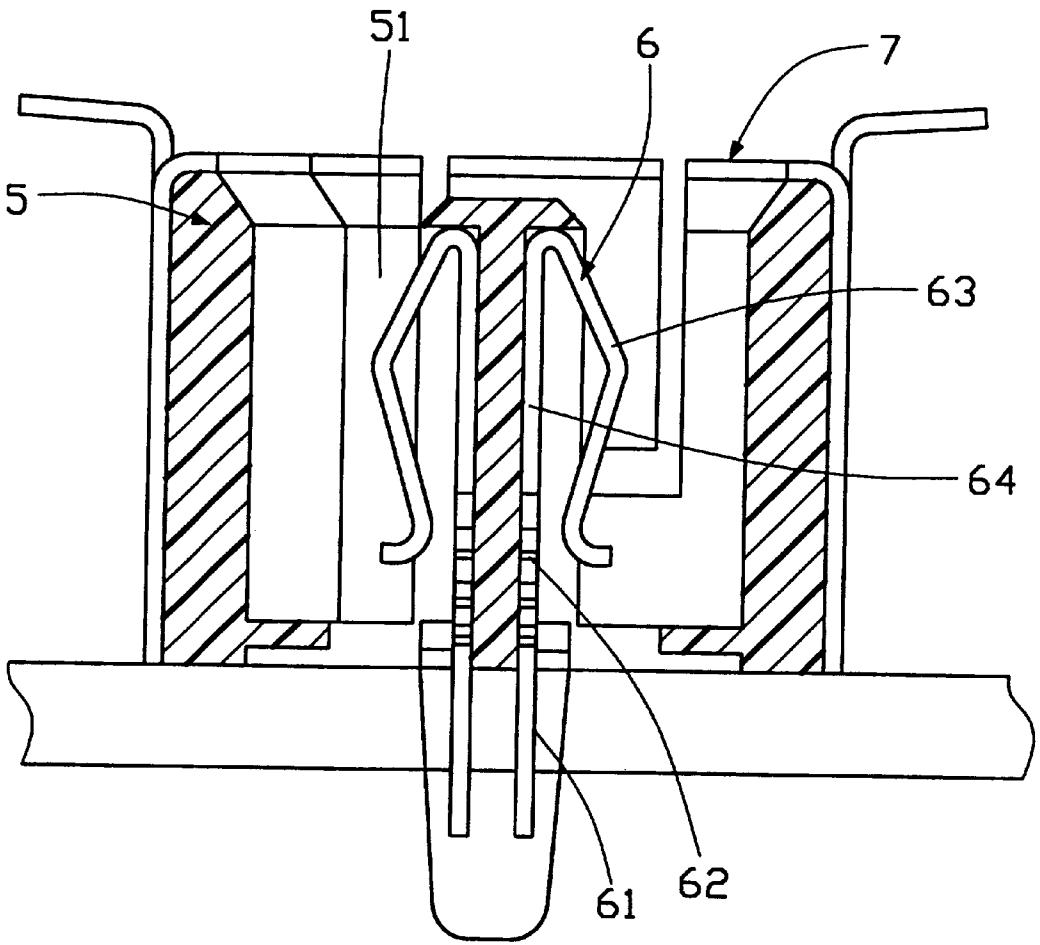
FIG. 11 (PRIOR ART)
FIG. 11 is a cross-sectional view of a conventional connector.

FIGS. 9–10 show a third embodiment of the present invention. The third embodiment is the same as the first embodiment with the exception that a cut face 19" is defined at the back of each side wall 16" and the top plate 17" of the shield 10" thereby exposing the solder tails 31" of the contacts 30" to an ultraviolet light during soldering to the printed circuit board, thereby strengthening the soldering connection between the solder tails 31" and the printed circuit board.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing comprising a body portion, a contact receiving cavity defined in a rear of the body portion, and a protruding portion projecting from a front of the body portion and defining a plurality of contact holding slots in communication with the receiving cavity, the protruding portion having a front portion forming a plurality of latching shelves, each latching shelf extending rearwardly into a corresponding contact holding slot;

a plurality of contacts received in the contact holding slots, each contact including a base section securely received in the receiving cavity, a solder tail rearwardly extending out of the body portion of the housing, and a horizontal section extending forwardly horizontally from a front side of the base section and defining a notch at a distal end thereof for locking to the latching shelf of the front portion of the protruding portion; and a metal shield covering the insulative housing;

wherein the notch of the contact has a shape in conformity to a profile of the latching shelf of the housing;

wherein a guide surface is provided on the upper surface of a front end of the horizontal section;

wherein the contact further comprises an arc-shaped spring contact section extending upwardly and rearwardly from a front end of the horizontal section for connection with a mating contact;

wherein the body portion of the housing comprises a pair of protrusions on side walls thereof for engaging with engagement holes of the shield;

wherein a chamfer is defined between a bottom plate and respective side plates of the shield;

wherein the shield has a cut face on the back thereof and above the solder tails assembled therein for exposing the solder tails.

* * * * *